United States Patent [19]

Suzuki et al.

[11] 4,430,538

[45] Feb. 7, 1984

[54] HIGH-FREQUENCY HEATING DEVICE

[75] Inventors: Yukio Suzuki; Syozo Kobayashi, both of Fuji, Japan

[73] Assignee: Tokyo Shibaura Denki Kabushiki Kaisha

[21] Appl. No.: 294,419

[22] Filed: Aug. 19, 1981

[30] Foreign Application Priority Data

| | | | |
|---|---|---|---|
| Aug. 28, 1980 | [JP] | Japan | 55-122212[U] |
| Nov. 11, 1980 | [JP] | Japan | 55-161054[U] |
| Nov. 11, 1980 | [JP] | Japan | 55-161056[U] |

[51] Int. Cl.[3] ..... H05B 6/72

[52] U.S. Cl. ..... 219/10.55 F

[58] Field of Search ..... 219/10.55 F, 10.55 E, 219/10.55 R

[56] References Cited

U.S. PATENT DOCUMENTS

| | | | |
|---|---|---|---|
| 2,618,735 | 11/1952 | Hall | 219/10.55 F |
| 2,748,239 | 5/1956 | Long et al. | 219/10.55 F |
| 2,813,185 | 11/1957 | Smith | 219/10.55 F |
| 2,831,952 | 4/1958 | Warner | 219/10.55 F |
| 2,920,174 | 1/1960 | Haagensen | 219/10.55 F |
| 2,961,520 | 11/1960 | Long | 219/10.55 F |
| 3,172,987 | 3/1965 | Fitzmayer | 219/10.55 F |
| 3,436,507 | 4/1969 | Puschner | 219/10.55 F |
| 3,443,050 | 5/1969 | Puschner | 219/10.55 F |
| 3,471,671 | 10/1969 | Puschner | 219/10.55 F |
| 3,532,847 | 10/1970 | Puschner | 219/10.55 F |
| 3,746,823 | 7/1973 | Whiteley | 219/10.55 F |
| 3,851,133 | 11/1974 | Dygve et al. | 219/10.55 F |
| 4,121,078 | 10/1978 | Takano et al | 219/10.55 F |
| 4,144,436 | 3/1979 | Hauck | 219/10.55 F |
| 4,176,266 | 11/1979 | Kaneko et al. | 219/10.55 F |
| 4,185,181 | 1/1980 | Kaneko et al. | 219/10.55 F |
| 4,343,976 | 8/1982 | Nasretdin et al. | 219/10.55 F |
| 4,350,859 | 9/1982 | Dudley et al. | 219/10.55 R X |

FOREIGN PATENT DOCUMENTS

| | | |
|---|---|---|
| 13500 | 11/1977 | Australia. |
| 2220959 | 10/1974 | France. |
| 2443025 | 12/1978 | France. |
| 1118378 | 11/1981 | Fed. Rep. of Germany. |
| 2948314 | 6/1980 | Fed. Rep. of Germany. |
| 2039200 | 7/1980 | United Kingdom . |

*Primary Examiner*—Volodymyr Y. Mayewsky
*Assistant Examiner*—Philip H. Leung
*Attorney, Agent, or Firm*—Cushman, Darby & Cushman

[57] ABSTRACT

A high-frequency heating device comprises a rotating disk including a base plate made of a material having low dielectric loss and arranged above in a heating chamber to rotate around its center axis, and a plurality of high-frequency screening pieces each arranged on the base plate and defining an exciting opening therebetween which has plural portions extending radially from the center axis to the outer circumference of the base plate. The rotating disk is driven by a motor or a part of air flow for cooling a magnetron whereby high frequency energy generated by a magnetron is introduced into the heating chamber through a waveguide and the exciting opening.

16 Claims, 15 Drawing Figures

HIGH-FREQUENCY HEATING DEVICE

BACKGROUND OF THE INVENTION

The present invention relates to a high-frequency heating device such as microwave oven, for example.

FIG. 1 shows a conventional high-frequency heating device wherein a magnetron (or high-frequency oscillator) 3 is arranged above a heating chamber 2 housed in a body 1 and a turn table 4 is arranged in the heating chamber 2. The turn table 4 rotates in such a way that food 5 or the like mounted on the turn table 4 can be uniformly heated however high-frequency energy emanated from the magnetron 3 may be distributed in the heating chamber 2.

However, with this prior art high-frequency heating device shown in FIG. 1, the circular turn table 4 is arranged in the box-shaped heating chamber 2 so that each corner of heating chamber 2 and its adjacent portion are left unused, thus making it impossible to efficiently use the inside of heating chamber 2. When the space in which food 5 or the like is practically housed and which will be hereinafter referred to as cooking space is kept to have a certain volume, the dimension of whole heating chamber 2 itself becomes bulky, thus making it difficult to make the whole of device small-sized. In addition, the arrangement of mounting food 5 or the like on the turn table 4 needs a large-sized driving motor 6 having comparatively large output to drive the turn table 4. This is another reason why the prior art device could not be improved in cost and size.

FIG. 2 shows another conventional high-frequency heating device wherein a heating chamber 2 and a magnetron (or high-frequency oscillator) 7 are housed in a body 1 and high-frequency energy emanated from the magnetron 7 is introduced into the heating chamber 2 through a waveguide 8 and an exciting opening 8*a* formed in the roof of heating chamber 2 while stirred by a stirrer fan 10 attached to the roof of heating chamber 2 so as to make the distribution of high-frequency energy good in the heating chamber 2. A partition plate 9 is provided for covering the stirrer fan 10 from below and being made of dielectric material having low dielectric loss (tan $\delta$).

With the prior art device shown in FIG. 2, the stirrer fan 10 arranged in the heating chamber 2 makes it necessary to form in the heating chamber 2 a comparatively large space in which the stirrer fan 10 is housed. In addition, the height of partition plate 9 must be made comparatively large. Therefore, when the cooking space in the heating chamber 2 is kept to have a certain volume, the whole of heating chamber 2 can not avoid being made comparatively bulky, which was a problem standing on the way of making the whole of device small-sized.

SUMMARY OF THE INVENTION

The present invention is intended to eliminate these drawbacks and the object of the present invention is therefore to provide a high-frequency heating device capable of keeping the distribution of high-frequency energy introduced into a heating chamber under better condition and making the whole of device smaller-sized.

In an aspect of the present invention, there is provided a high-frequency heating device comprising a housing with a heating chamber housed therein; a high-frequency oscillator; means for introducing high-frequency, which is emanated from the high-frequency oscillating means, from above and into the heating chamber; a rotating disk including a base plate made of a material having low dielectric loss and arranged above in the heating chamber to rotate around its center axis, and a plurality of high-frequency screening pieces each arranged on the base plate and defining an exciting opening which has plural portions extending radially from the center axis to the outer circumference of base plate; and driving means for rotating the rotating disk; wherein high-frequency energy is introduced into the heating chamber through the exciting opening of rotating disk.

DETAILED DESCRIPTION OF THE PREFERRED EMBODIMENTS

An embodiment of high-frequency heating device according to the present invention will be described with reference to the accompanying drawings.

Figure 1:
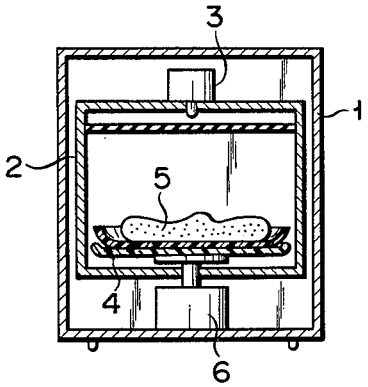
FIGS. 1 and 2 are sectional views showing prior art high-frequency heating devices, respectively.
Figure 2:
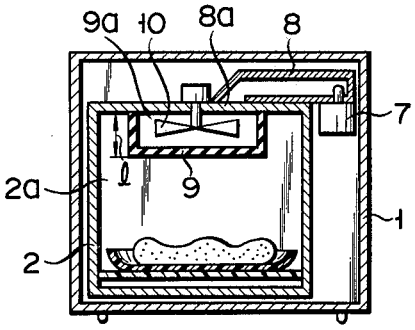
Figure 3:
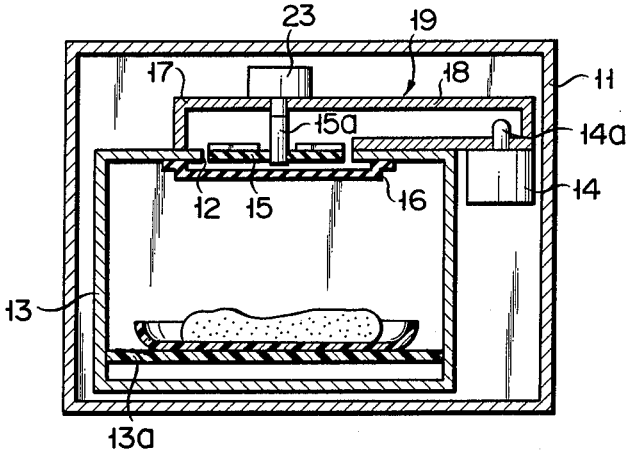
FIGS. 3 and 4 are longitudinally-sectioned and cross-sectioned views showing an embodiment of high-frequency heating device according to the present invention.
Figure 4:
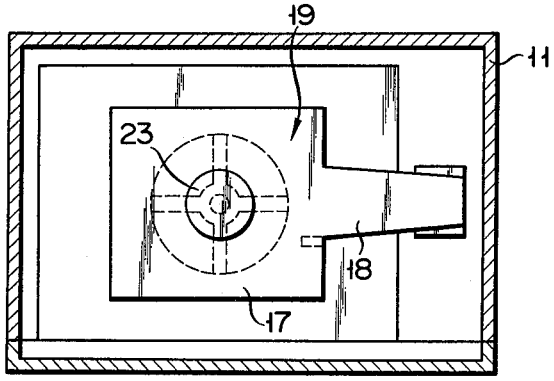

FIGS. 3 and 4 show the schematic arrangement of a high-frequency heating device such as microwave oven, for example, in which numeral 11 represents a box-shaped body. In the body 11 are housed a heating chamber 13 provided with a circular hole (or opening) 12 in the center of roof thereof, and a magnetron (or high-frequency oscillator) 14. A shelf plate 13*a* on which food is mounted is arranged adjacent to the bottom of heating chamber 13. The circular hole 12 formed in the roof of heating chamber 13 is closed by a partition plate 16, which is made of a material having low dielectric loss (tan $\delta$) such as polypropylene plastic and arranged below the circular hole 12 so as to screen a rotating disk 15, which will be described later, from vapor and the like in the heating chamber 13. On the roof of heating chamber 13 is arranged a hollow box 17 so as to close the circular hole 12 from above. This hollow box 17 is associated with a connection part 18, which electromagnetically couples the hollow box 17 with an antenna portion 14*a* of magnetron 14, to form a waveguide 19. In the circular hole 12 is concentrically arranged the rotating disk 15 having a diameter a little smaller than that of circular hole 12. As shown in FIGS.

5 and 6, the rotating disk 15 comprises a circular base plate 20 made of a material having low dielectric loss and high-frequency transmission coefficients, and high-frequency screening pieces 21 which are formed by four pieces of fan-shaped light metal such as aluminum each having a central angle of 90. These high-frequency screening pieces 21 are arranged on the base plate 20 in such a way that their arched edges are in accord with the outer circumference of base plate 20 and that a cross-shaped exciting opening 22 having a width B is formed between their straight-lined edges. The rotating disk 15 has a shaft 15*a* connected to the rotating shaft of a motor 23 which is mounted on the roof of hollow box 17, and is rotated on a horizontal plane taking the shaft 15*a* as its center. The shaft 15*a* is made of low dielectric loss material and may be formed integral with the base plate 20.

With the high-frequency heating device having such arrangement as described above, high-frequency energy emanated from the magnetron 14 is introduced into the hollow box 17 through the connection part 18. High-frequency energy introduced into the hollow box 17 is almost all reflected by surfaces of screening pieces 21 and thus prevented from entering into the heating chamber 13 through the pieces 21. Therefore, high-frequency energy in the hollow box 17 is almost introduced into the heating chamber 13 through the exciting opening 22. The exciting opening 22 is rotated associating with the rotation of rotating disk 15 so that high-frequency introduced into the heating chamber 13 can be distributed uniformly.

When the ring-shaped space formed between outer circumferences of rotating disk 15 and circular hole 12 is made large in the case of device as described above, a fear is caused that high-frequency is allowed to enter through the ring-shaped space into the heating chamber 13 to make temperature distribution irregular. It has been found by tests that high-frequency energy can not enter into the heating chamber 13 through the space when the space is made smaller than $\lambda/8$ providing the wavelength of high-frequency to be $\lambda$. Therefore, when the frequency of high-frequency wave oscillated from the magnetron 14 is 2450 MHz, for example, it is preferable that dimensions of circular hole 12 and rotating disk 15 are determined to have a space less than 15 mm, between their outer circumferences, wherein the wavelength is represented by $\lambda \approx 122$ mm in this case. It is also preferable that the diameter A of rotating disk 15 is set odd-number times $\lambda/2$ so that the maximum amount of high-frequency energy can be introduced in the center of rotating disk 15, that is, of exciting opening 22, thus making smaller the difference between temperatures in the center portion and around the center portion of heating chamber 13 to thereby improve temperature distribution in the heating chamber 13.

Figure 7:
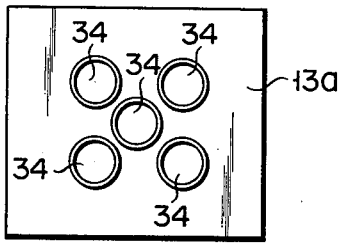
FIGS. 7 and 8 are plane and sectional views showing a variation of rotating disk.

Results of temperature distribution tests conducted and those of cases where sponge cakes were practically made using the high-frequency heating device provided with the rotating disk 15 as described above will be shown in the following. In temperature distribution tests were used five water loads 34 positioned on the shelf plate 13*a* as shown in FIG. 7 and heating time was two minutes and thirty seconds. Temperature distribution ratio is expressed as follows.

$$\text{Distribution ratio} = \frac{\text{maximum rise value of temperature} - \text{minimum rise value of temperature}}{\text{average rise value of temperature}} \times 100(\%)$$

Namely, Table 1 shows cases where the width B of exciting opening 22 is kept certain to be 25 mm while the diameter A of rotating disk 15 is changed. The difference between thicknesses of swelled sponge cakes corresponds to the one between maximum and minimum heights of sponge cakes after the finish of cooking.

TABLE 1

| Diameter A (mm) | 120 | 140 | 160 | 180 | 200 | 220 |
|---|---|---|---|---|---|---|
| Distribution ratio (%) | 43 | 38 | 30 | 23 | 33 | 39 |
| Difference between thicknesses of sponge cakes (mm) | 25 | 22 | 18 | 15 | 20 | 24 |

It is clear from Table 1 that temperature distribution is uniform when the dimension of diameter A is substantially equal to three times $\lambda/2$ ($\fallingdotseq$183 mm: $\lambda/2 \fallingdotseq 61$ mm when $\lambda \fallingdotseq 122$ mm), that is, $A \fallingdotseq 180$ mm. It is also clear in this case that the inside of oven is uniformly heated at the center and its surroundings to make smallest the difference between thicknesses of swelled spong cakes and that the cooking thus finished is good accordingly.

Table 2 shows test results in the case where the diameter A of rotating disk 15 is kept certain to be 180 mm (the optimum value in Table 1) while the width B of exciting opening 22 is changed.

TABLE 2

| Width B (mm) | 10 | 20 | 30 | 40 | 50 |
|---|---|---|---|---|---|
| Distribution ratio (%) | 20 | 23 | 26 | 38 | 43 |
| Difference between thicknesses of risen sponge cakes (mm) | 15 | 14 | 15 | 25 | 25 |

It is clear from Table 2 that temperature distribution is made uniform when the slit width B is in about $\lambda/4$ ($\fallingdotseq$30 mm) and that the cooking of sponge cakes thus finished is good. Therefore, it is preferable that the width B of exciting opening 22 formed in the rotating disk 15 is set less than $\lambda/4$.

With the high-frequency heating device as described above, the exciting opening 22 of rotating disk is accurately cross-shaped, but may be shaped to have a larger width in the center of rotating disk than that at the outer circumference thereof, thus making it possible to cause high-frequency energy to be concentrated in the center of rotating disk so as to make more uniform temperature distribution in the heating chamber.

Figure 8:
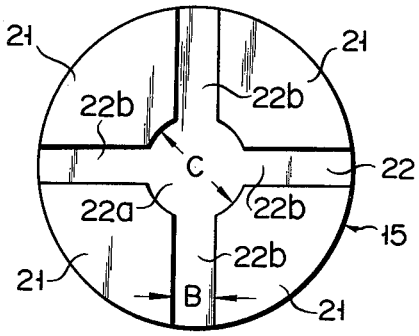
Figure 9:
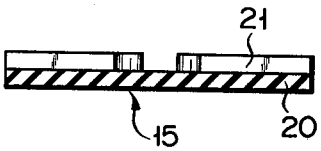
FIGS. 9 and 10 show tests to prove the property of high-frequency heating device according to the present invention.

As shown in FIGS. 8 and 9, each of screening pieces 21 defining the exciting opening 22 of rotating disk 15 is cut off in arched shape at the top edge thereof. As the result, the width C of exciting opening 22*a* in the center of rotating disk 15 becomes larger than that B of exciting opening 22*b* adjacent to the circumference of rotating disk 15. In one particular embodiment as shown in FIGS. 8 and 9, the width C of exciting opening 22*a* is 50 (mm) while that B of exciting opening is 30 (mm).

Figure 5:
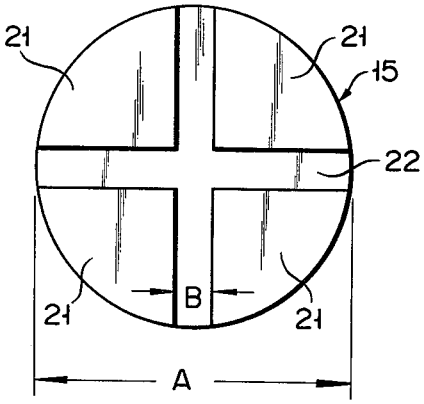
FIGS. 5 and 6 are plane and sectional views showing a rotating disk employed in the high-frequency heating device.
Figure 6:
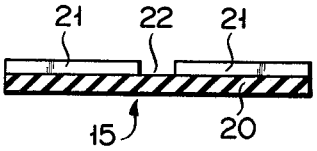

There will be described comparison tests on effects achieved by the high-frequency heating device in which the rotating disk (or the first rotating disk) shown in FIG. 5 and the one (or the second rotating disk) shown in FIG. 8 are employed, respectively.

The first test is intended to examine the distribution state of high-frequency energy introduced into the heating chamber and was carried out similarly in already-described tests in such a way that five containers 34 were positioned on the shelf 13*a* in the heating chamber and that the magnetron was operated for a certain time period to examine the temperature rise value of water (300 cc) contained in each of containers 34. It was provided that $$\text{Distribution ratio } (Y) = \frac{\text{max. rise value} - \text{min. rise value}}{\text{average rise value}} \times 100(\%)$$

The rotating disk 15 in which the width of exciting opening 22 in the center thereof was same as that of exciting opening adjacent to the outer circumference thereof and the one in which the former was larger than the latter, that is, first and second rotating disks were employed, respectively. Table 3 shows test results thus conducted.

TABLE 3

| | First rotating disk | Second rotating disk |
|---|---|---|
| Distribution ratio (Y) | 20% | 12.6% |

As apparent from Table 3, the distribution ratio (Y) is comparatively large when the first rotating disk is employed. This teaches that the deviation in temperature rise values of water contained in containers 34 is large. The temperature rise value of water contained in the container which was positioned in the center of shelf plate 13*a* is smallest in this case. The distribution ratio (Y) becomes small when the second rotating disk is employed. This teaches that the deviation in temperature rise values of water contained in containers 34 is small. Therefore, when the width of exciting opening 22 in the center of rotating disk 15 is made same as that adjacent to the outer circumference of rotating disk 15, food or the like mounted on the shelf plate 13*a* in the center thereof is more difficultly heated than those around it. However, when the width of exciting opening 22 in the center of rotating disk 15 is made larger than that adjacent to the outer circumference of rotating disk 15, high-frequency energy introduced into the heating chamber 13 through the center portion of exciting opening 22 can be increased to adjust the distribution state of high-frequency energy, so that food of the like mounted on the shelf plate 13*a* can be uniformly heated.

Figure 10:
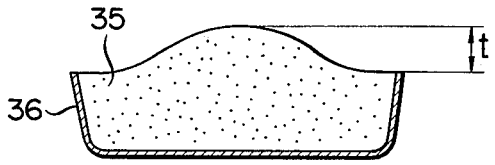

The second test was carried out in such a way that a container 36 in which material of sponge cake 35 was contained was mounted on the shelf plate 13*a* in the heating chamber 13 and that the state of sponge cake baked (or the height between center portion of swelled sponge cake 35 and the top edge of container 36 as shown in FIG. 10) was examined, respectively, in cases where first and second rotating disks were used. Table 4 shows test results.

TABLE 4

| | First rotating disk | Second rotating disk |
|---|---|---|
| Sponge cake (t) | 14 mm | 10 mm |

As apparent from Table 4, the center portion of sponge cake 35 is swelled high or the value t becomes large when the first rotating disk is employed, while the center portion of sponge cake 35 is swelled less high or the value t becomes small when the second rotating disk is employed. Therefore, when the width of exciting opening 22 in the center of rotating disk is made larger than that adjacent to the outer circumference thereof, the whole of sponge cake 35 can be more uniformly heated and material such as sponge cake having comparatively large volume can therefore be baked well.

Figure 11:
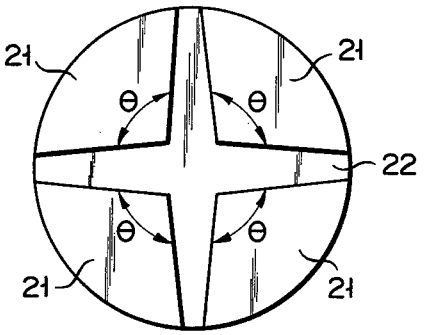
FIGS. 11 and 12 are plane and sectional views showing another variation of rotating disk.
Figure 12:
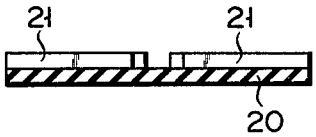

For the purpose of making the center portion 22*a* larger than the circumference portion 22*b* in the rotating disk 15, formation as shown in FIGS. 11 and 12 may be employed. Namely, each of four screening pieces 21 arranged on the base plate 20 is formed by a fan-shaped metal piece whose center angle $\theta$ is larger than 90° and arranged symmetrically one another around the center of base plate 20 with its outer circumference positioned in accord with that of base plate 20. As a result, the exciting opening 22 becomes larger in width as it comes to the center thereof, thus allowing high-frequency to be concentrated in the center of rotating disk 15.

Figure 13:
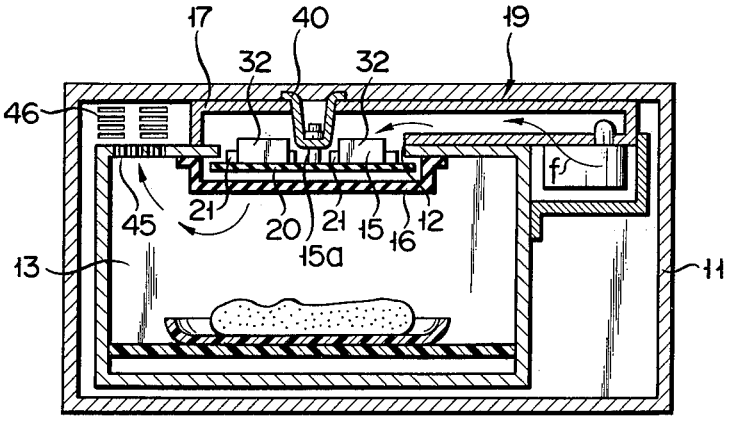
FIGS. 13 and 14 are longitudinally-sectioned and cross-sectioned views showing another embodiment of high-frequency heating device according to the present invention.
Figure 14:
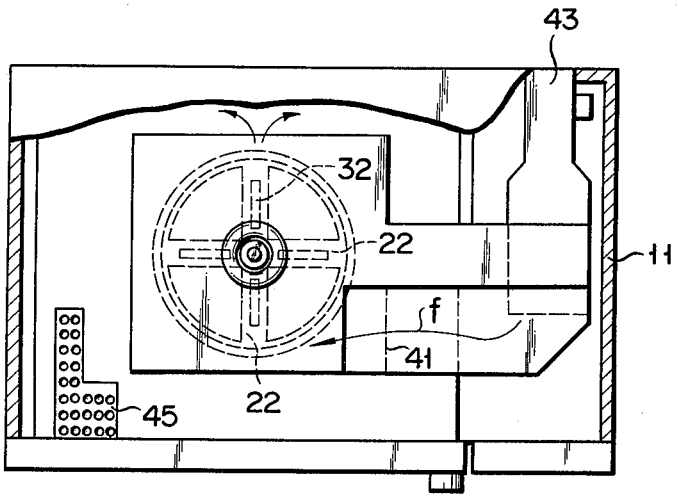
Figure 15:
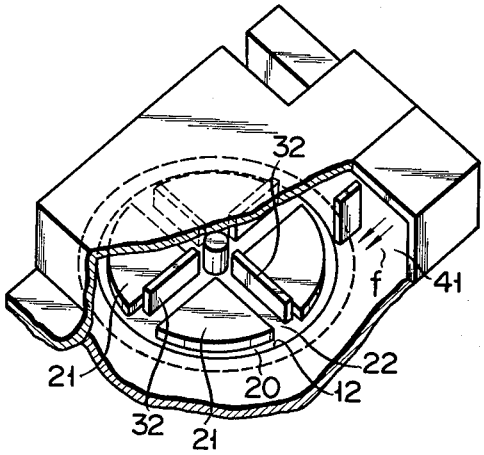
FIG. 15 is a perspective view showing a rotating disk employed in the high-frequency heating device showing in FIGS. 13 and 14.

Another embodiment of high-frequency heating device according to the present invention will be described with reference to FIGS. 13 through 15. Same parts as those in the above-described example are represented by same numerals and description about these parts will be omitted.

Above the partition plate 16 arranged above in the heating chamber 13 is rotatably hung the rotating disk 15. The rotating disk 15 is positioned under the circular hole 12 because the base plate 20 has a diameter larger than that of circular hole 12. Each of screening pieces 21 made of metal pieces is formed to have a radius same as that in the already-described example and positioned in the circle of circular hole 12. In the exciting opening 22 defined by these screening pieces 21 are arranged four pieces of rotating wings 32, respectively, each of rotating wings 32 extending radially on the disk 15, having its upper surface projected above that of screening pieces 21 and being shaped in rectangle and made of material having low dielectric loss. It is preferable that these rotating wings 32 are made of same material as that of base plate 20 and formed integral to the base plate 20. The shaft 15*a* projects upwards in the center of rotating disk 15 and attached by means of bolts or welding to the roof of hollow box 17 which forms the waveguide 19. The shaft 15*a* is rotatably supported by a bearing 40 which is hung into the hollow box 17. It is preferable that the bearing 40 has a height equal to about $\frac{1}{4}$ of wavelength of high-frequency energy. The bearing 40 is formed by a metal cylinder and serves to function as a high-frequency stub. The employment of stub like this allows high-frequency propagated through the waveguide 19 to be efficiently introduced into the heating chamber 13.

For the purpose of determining the height of bearing 40, tests were conducted using various bearings which were different from one another in height. Table 5 shows measurement results relating to the distribution ratios (%) and the differences (mm) between thickness of sponge cakes swelled.

TABLE 5

| Stub | zero | 10 mm | 20 mm | 25 mm | 30 mm | 35 mm | 40 mm |
|---|---|---|---|---|---|---|---|
| Distribution ratio (%) | 23 | 23 | 20 | 17 | 15 | 18 | 23 |
| Difference between thicknesses of sponge cakes (mm) | 14 | 14 | 13 | 12 | 10 | 11 | 14 |

It can be understood from Table 5 that the distribution ratio and the difference between thicknesses of sponge cakes have preferable values and the distribution of high-frequency is more uniform when the bearing having a height of 30 mm which is equal to about $\frac{1}{4}$ of wavelength (about 122 mm) of high-frequency energy is employed.

An air supply port 41 is formed in one end of waveguide 19 on the inlet side thereof. A fan blower 43 which is rotated by a motor is arranged in the housing 11 and supplies air into the heating chamber 13 through an air supply gap defined by the top plate of heating chamber 13, the rotating disk 15 and the partition plate 16 and holes (not shown) perforated in the partition plate 16, to thereby cool the heating chamber 13. In roofs of heating chamber 13 and the back wall of housing 11 are formed air discharge ports 45 and 46, respectively, through which air used to cool the heating chamber 13 is discharged outside the housing 11. Air supplied by the blower 43 is partly sent into the hollow box 17 through the air supply port 41, as shown by an arrow, and then discharged outside through the port 46 thereby to drive the rotating disk 15.

With the high-frequency heating device having such arrangement as described above, the rotating disk 15 is not rotated by a motor but by a part of air flow for cooling the magnetron 14. Namely, rotating wings 32 of disk 15 are urged by a part of air flow for cooling the magnetron 14, so that the rotating disk 15 is rotated taking the rotating shaft 15*a* as its center. Therefore, same effect as that achieved in the first example can be attained without using the motor for driving the rotating disk 15.

With examples of high-frequency heating device, the exciting opening of rotating disk 15 is formed in substantial cross shape in any examples but may be formed in any shape in such a way that it has plural portions extending radially from the center of rotating disk to the outer circumference thereof and crossed in the center thereof, for example.

As described above, the rotating disk comprising the base plate of low dielectric loss and high-frequency screening pieces which define the exciting opening having plural portions extending radially from the center of rotating disk to the outer circumference thereof is arranged above in the heating chamber and high-frequency is introdced into the heating chamber through the exciting opening according to the high-frequency heating devide of the present invention. Therefore, a larger amount of high-frequency is introduced into the heating chamber through the center portion of rotating disk to thereby make temperature distribution uniform in the heating chamber. In addition, this rotating disk can be made thinner as compared with the conventional stirrer fan and rotating table and allows the above-mentioned effect to be attained even if it is small-sized. The whole of device can be small-sized accordingly.

What we claim is:

1. A high-frequency heating device comprising:

a housing;

a heating chamber within said housing, said heating chamber having an opening therein for the introduction of high-frequency energy into the heating chamber;

a high-frequency generator;

means for transmitting high-frequency energy from said generator to said opening in said heating chamber;

a rotating disk, mounted for rotation within said opening, for guiding energy from said transmitting means into said heating chamber, said disk having a base plate made of a low dielectric loss material and a plurality of high-frequency screening pieces arranged on the base plate and defining high-frequency exciting slots between the screening pieces which extend radially from the central axis of the base plate to the outer circumference thereof so that a distribution of high-frequency energy across said opening has a maximum value at a central axis of said opening and is supplied therethrough to said heating chamber; and driving means for rotating said rotating disk.

2. A high-frequency heating device according to claim 1 wherein said opening is provided in a roof portion of said heating chamber, the rotating disk being arranged to substantially cover the entire opening, the transmitting means being arranged on the roof portion of the heating chamber and having a waveguide communicating with said opening.

3. A high-frequency heating device according to claim 2 wherein the opening is circular and the rotating disk is concentrically arranged in the opening.

4. A high-frequency heating device according to claim 3 wherein the rotating disk has such a diameter that the space between its outer circumference and the inner circumference of the opening is made smaller than about $\frac{1}{8}$ of the wavelength of high-frequency energy.

5. A high-frequency heating device according to claim 1 wherein the rotating disk has a diameter equal to about three times $\frac{1}{2}$ of the wavelength of high-frequency energy.

6. A high-frequency heating device according to claim 1 wherein the exciting slot has a plurality of slits extending radially from the center axis to the outer circumference of the base plate and through which the upper surface of the base plate is exposed energy.

7. A high-frequency heating device according to claim 6 wherein each of the slits has a width smaller than $\frac{1}{4}$ times the wavelength of high-frequency energy.

8. A high-frequency heating device according to claim 6 each of the slits becomes wider as it comes to the center axis of the base plate.

9. A high-frequency heating device according to claim 2 wherein the driving means includes a shaft projected from the rotating disk coaxially with the center axis of the rotating disk, a bearing for rotatably supporting the shaft, and a driving source for rotating the rotating disk relative to the bearing.

10. A high-frequency heating device according to claim 9 wherein the driving source has a motor for rotating the shaft.

11. A high-frequency heating device according to claim 9 wherein the driving means has wing members projected on the rotating disk and the driving source has a blower for supplying air to rotate the rotating disk.

12. A high-frequency heating device according to claim 11 wherein the heating chamber has an air supply port through which a part of air blown by the blower is supplied into the heating chamber and an air discharge port through which air is discharged from the heating chamber.

13. A high-frequency heating device according to claim 9 wherein the bearing has a high-frequency stub projected into the waveguide to have a length equal to $\frac{1}{4}$ of the wavelength of high-frequency energy.

14. A high-frequency heating device according to claim 1 wherein the high-frequency screening pieces are fan-shaped metal plates arranged symmetrically around the center axis of the base plate and each of the slits is defined by the adjacent sides of the metal plates.

15. A high-frequency heating device according to claim 4 wherein each of the fan-shaped metal plates has corners spaced by a certain distance from the upper surface of the base plate.

16. A high-frequency heating device according to claim 14 wherein the base plate has a plurality of through-holes and each of the fan-shaped metal plates is positioned on the base plate with its corner faced the through-hole.

* * * * *